United States Patent [19]

Carstensen

[11] Patent Number: 4,525,287

[45] Date of Patent: Jun. 25, 1985

[54] THREAD AND BEARING LUBRICANT

[76] Inventor: Kenneth J. Carstensen, 4540 N. 44th St. No. 70, Phoenix, Ariz. 85018

[21] Appl. No.: 621,267

[22] Filed: Jun. 18, 1984

[51] Int. Cl.[3] ..... C10M 1/54

[52] U.S. Cl. ..... 252/26; 252/28; 252/29; 252/56 R; 252/58

[58] Field of Search ..... 252/26, 28, 29, 56 R, 252/58

[56] References Cited

U.S. PATENT DOCUMENTS

| | | | |
|---|---|---|---|
| 2,700,623 | 1/1955 | Hall | 252/26 |
| 3,652,414 | 3/1972 | Bergeron | 252/26 |
| 4,155,860 | 5/1979 | Soucy | 252/26 |
| 4,379,062 | 4/1983 | Prengamon | 252/26 |

*Primary Examiner*—Jacqueline V. Howard
*Attorney, Agent, or Firm*—Fraser and Bogucki

[57] ABSTRACT

A lubricant composition for thread or bearing surface operated at high temperature and stress load conditions, a thixotropic mixture including a Jojoba base vehicle, metallic and non-metallic particulates, a metallic component for wetting the stressed thread or bearing surfaces, together with non-metallic particulates that coat the stressed surfaces and other metallic particulate solids also wet by the metallic component. The lubricating vehicle retains the composition in place under extremely high temperatures without gassing off so that the particulate elements function properly to permit relative sliding motion of the stressed surfaces.

15 Claims, No Drawings

THREAD AND BEARING LUBRICANT

BACKGROUND OF THE INVENTION

This invention relates to a novel thread and bearing lubricant composition, and is particularly directed to a lubricant and sealant composition for downhole applications in the oil industry where high temperatures and forces are encountered.

Many oil filed tube and casing system, and many down-hole drilling tools and devices such as drill bits and roller reamers are required to operate in high pressure, high temperature environments that may be corrosive. Furthermore high loads and stresses are imposed on mating surfaces, so that in lubrication of contacting surfaces it becomes extremely difficult to provide a system that functions well under all these conditions.

A typical prior art lubricant composition for demanding (high pressure or high stress, or both) applications comprises a grease, powdered graphite, lead powder, zinc dust and copper flake. Such composition has been employed on stainless steel tube and casing systems needed for high temperature corrosive environments, but not satisfactorily because of certain problems with stainless steel, which is particularly subject to galling under these conditions.

Frequently there is severe galling of the contacting threads of stainless steel couplings and pipe threaded pin ends during make-up, and frequently also the contacting threads of the couplings seize on break-out. Gall stress in stainless steel arises from high point contact loading, resulting in localized heating that fluidizes or vaporizes the thread lubricant medium (e.g. grease) in the lubricant compound.

Other prior art lubricants for these applications include molybdenum di-sulfide, lithium based greases and teflon based pipe dopes. None have heretofore satisfactorily met the requirements imposed by high temperature, high stress loaded systems. Commonly, the low viscosity carrier for the lubricating solids has tended to bake-out or cook-out of the thread or bearing region at high temperature and pressure. Bake-out is caused principally by heat conduction into the region from a radiant or conducive source. Cook-out results from the intrusion of high temperature fluids into the threaded root helix, or the mating surfaces of bearing areas. In either event, only a dried residue of decomposition that is devoid of sealing capability is left. Moreover, the dried residue interposed between thread or bearing surfaces has such low lubricant properties that it generates extra friction, on breakout of a coupling for example, resulting in galling of the members.

It is desirable to provide a thread and bearing having enhanced lubrication and sealing properties, and which is resistant to breakdown under the high temperature and environmental conditions encountered in oil and gas well production pipes and especially geothermal applications. Further, such lubricant must conform to ASTM specifications for casing, tubing and line pipe thread compound. It is also desirable to provide an improved lubricant composition having the aforementioned advantageous properties, and formed of readily available constituents which can be easily formulated into a storable mix that can be applied with facility to thread or bearing surfaces at any location, such as a pipe mill, a pipe yard, a machine shop, and especially when running pipe into the well bore at the rig site.

SUMMARY OF THE INVENTION

According to the invention, there is provided a novel thread and bearing lubricant formulation or composition particularly advantageous for application where high temperatures (such as geothermal wells) and stresses are to be encountered. The composition incorporates, in a thickened base vehicle of high temperature jojoba oil, a substantial proportion of metallic particulates and a lesser amount of indium. Under high stress conditions the indium distributes itself on the metallic surfaces and diffuses into the surfaces, which are thereby hardened. In addition, non-metallic particulates are used that coat the stressed surfaces to lessen tendencies to adhesion. The composition remains in place on the contacting surfaces even after long exposure to high temperature environments, because of its temperature resistant properties and a thixotropic character that enables movement as a fluid despite settling into a solid after remaining static for a time. Thus, sealing properties are maintained when in use, but lubricant characteristics are preserved during makeup and after exposure, as in the breakout of threaded forms.

The thread lubricant and sealant composition is prepared by mixing solid metallic or semiconductive particulates in a high temperature, hydrophobic greases formed of a thickened jojoba oil formulation, and including a minor proportion of indium and some non-metallic particulates.

DETAILED DESCRIPTION OF THE INVENTION

An essential component of the novel lubricant composition of the invention is a grease incorporating jojoba oil and thickened with "Cabosil" colloidal silica. The jojoba based grease provides a thermally stable, hydrophobic high temperature vehicle which distributes itself uniformly between stressed surfaces and serves as an excellent barrier to water and water vapor transmission under high pressure and high temperature. Such grease is thus highly stable, has good wear resistant properties, and has essentially constant viscosity. Because jojoba oil remains liquid at 690° F., and because of its stability, it does not evaporate or migrate away from the bearing or stressed site. The jojoba oil is thickened with the addition of about 30% of its weight of "Cabosil".

The jojoba based grease serves as a distribution vehicle for a major proportion of fine particulate of the self-bearing type, such as lead, zinc, copper and graphite powders. One or a number of these metallic or semi-metallic powders, having a mesh size of less than 200, may be used. The particulates are interposed between and facing stressed surfaces and function as minute distributed roller bearings so as to reduce friction. By using these constituents the torque level needed for making a particular coupling can be adjusted to a selected value.

Indium powdered metal is another essential component of the invention composition. Indium is a readily fusible metal which rapidly diffuses into a substrate metal surface, when the metal thread flanks of contacting thread forms such as pipe couplings and pins smear over each other as the threads are made up, resulting in a tapered interference fit. Under the stresses of thread makeup or high bearing pressure the indium is distributed on the stressed surfaces. Indium does not work harden, so that it acts as wetting or diffusing agent on the metal surfaces. As the indium diffuses into the substrate metal surface, its action is to strengthen and harden the thread surface even after repreated load cycles. It also, moreover, has an apparent affinity for other particulates used in the formulation, both those mentioned above and those mentioned immediately hereafter.

A solid particulate fluorocarbon, particularly $CF_x$ (carbon monofluoride), is another component of the invention and is employed in powder form. As the flanks of cooperating thread forms, e.g., pipe couplings and pins, move against each other, a burnishing action is created which enables the carbon monofluoride to lay down an adherent wear resistant lubricating layer, preventing metal-to-metal contact of the thread flanks.

Another component of the thread lubricant composition of the invention is the material marketed as "Ekonol" by Carborundum Corporation, which is understood to be a soild particulate linear aromatic polyester. This material provides a bearing-like action between contacting thread or bearing surfaces, which is complementary to and is enhanced by the action of the particulate fluorocarbon and the indium.

The composition is thixotropoic in character in that it settles into an apparent solid after remaining static for a time but flows (with substantial viscosity) when subjected to shear stress. Consequently it can be agitated and uniformly applied with ease, but stays in place. Furthermore, the active lubricating agent, jojoba oil, does not fume off or flow out when high temperatures are reached. Unlike prior art compositions, therefore, temperatures of up to about 700° F. do not leave a dry residue which actually increases adhesion. Instead, composition in accordance with the present invention retain all the essential lubricating functions, holding the grease component in place, which in turn isolates the particulate elements from each other, and enabling them to function.

Thus, in the mixture the above components of the novel lubricant of the invention coact to provide excellent lubricating and sealing properties under high temperatures and stresses. The lubricant is especially valuable in preventing galling and seizure of metal thread and bearing forms.

Major components of novel thread lubricant composition in accordance with the invention are employed in the general and preferred ranges of proportions, in percent by weight, set forth in the table below.

TABLE 1

| Components | Ranges (% by Wt.) General | Preferred |
|---|---|---|
| Jojoba base grease | 15–50 | 20–40 |
| Metallic and/or semi-metallic particulates | 40–65 | 45–65 |
| $CF_x$ (carbon monofluoride) | 0.5–10 | 0.5–5 |
| Ekonol (aromatic polyester) | 0.5–10 | 0.5–5 |
| Indium (Powdered metal) | 0.5–10 | 0.5–5 |

Jojoba base grease in this example is a mixture of 90% pure jojoba oil and 10% pure sulphur. Further thickeners may be added as described below.

The metallic and semi-metallic particulates can be used in the following percentages set forth in Table 2, in relation to total weight of the composition.

TABLE 2

| Components | % by Wt. |
|---|---|
| Graphite | 3–20 |
| Lead | 3–20 |
| Zinc | 2–15 |
| Copper | 2–10 |

Examples of other thread lubricant compositions in accordance with the invention are set forth in Table 3 below.

TABLE 3

| Components | Composition (% by Wt.) A | B | C |
|---|---|---|---|
| Jojoba base grease thickened with 20–33.5% "Cabosil" | 36.0 | 25.0 | 30.0 |
| Powdered graphite | 16.0 | 20.0 | 15.0 |
| Lead powder | 29.5 | 32.0 | 25.0 |
| Zinc dust | 12.1 | 12.0 | 10.0 |
| Copper flake | 3.3 | 3.0 | 6.0 |
| Carbon monofluoride ("$CF_x$") | 1.0 | 3.0 | 5.0 |
| "Ekonol" | 1.0 | 3.0 | 4.0 |
| Indium powder | 1.0 | 2.0 | 5.0 |
| | 100.0 | 100.0 | 100.0 |

Composition A of Table 3 above is an optimum thread lubricant according to the invention. In formulating the thread composition of the invention, the grease and the metallic and non-metallic solids particulate components are mixed together in a conventional mixer apparatus to produce a blended uniform mixture of the solid particulate components in the grease, which functions as the vehicle. The resulting composition is applied as a coating or a layer onto the thread flanks of thread forms to be assembled, e.g., stainless steel pipe couplings, prior to make-up of the couplings. The composition can also be applied to other stressed devices to be exposed to high temperatures, such as journal bearing bits used in deep drilling and geothermal wells, cones used on drilling bits, and carbon steel or stainless steel joinders in geothermal wells.

The following are examples of use of the lubricant composition of the invention.

EXAMPLE 1

Composition A of Table 3 was formulated by mixing the powdered graphite, the lead powder, zinc dust, copper flake, carbon monofluoride, Ekonol and indium powder, with the thickened jojoba based grease, in the proportions shown in Table 3, in a Brabend mixer, until a homogeneous suspension of the solid particulate components in the grease vehicle was obtained.

The thread composition so formed conforms to ASTM Specification D92; D217; and D566, set forth in API Bulletin 5A2 for casing, tubing and line pipe thread compound.

The resulting composition A was applied, after further stirring to restore fluidity, to the threads of stainless steel pipe couplings employed for oil and gas well production pipe, and the couplings were made up without any galling of the threaded connections and without seizure on break-out of such connections. Sealing of the couplings during operation was also provided, preventing passage of gases or liquids across a pressure gradient of the order of about 6,000 psi at high temperature of the order of about 700° F.

EXAMPLE II

Composition B of Table 3 was formulated employing substantially the same procedures as for Composition A in Example I above.

The resulting composition B was applied in the form of a thin coating into the threaded connection of 22% chrome-stainless steel pipe couplings of oil, gas and geothermal well production pipes. The couplings were made up and following a period of operation including pressure and temperature cycles the couplings were broken out. Absence of galling and seizure on make-up and break-out were noted, as in the case of Example I.

From the foregoing, it is seen that the invention provides a novel thread lubricating composition containing as essential components Jojoba base grease as vehicle, together with metallic and/or semi-metallic particulates, and carbon monofluoride, an aromatic polyester, particularly "Ekonol", $CF_x$ and indium, each in solid particulate form. The novel components of the composition cooperate to provide lubrication and sealing properties substantially greater than the additive effects of the individual components. These properties are complementary in function and are such that they cooperate to lubricate and seal high stress joinders and bearings.

The control and performance tests specified in API Bulletin 5A2 are met and greatly exceeded by the novel lubricant/sealant composition of the invention.

Since various changes and modifications of the invention will occur to and can be made readily by those skilled in the art without departing from the invention concept, the invention is not to be taken as limited except by the scope of the appended claims.

What is claimed is:

1. A lubricant composition for thread and bearing surfaces to be exposed to high temperature and stress loading which comprises about 15 to 50% thickened jojoba oil as a vehicle, about 0.5 to 10% indium, in solid particulate form, metallic and/or semi-metallic lubricating particulates, and about 0.40 to 10% non-metallic particulates.

2. The composition of claim 1, wherein said metallic and/or semi-metallic lubricating particulates are selected from the class including lead, zinc, graphite and copper.

3. The composition of claim 1, wherein said non-metallic particulates comprise an aromatic polyester and a carbon monofluoride.

4. The composition of claim 3, employing about 10 to about 40% of said Jojoba base grease, about 40 to about 65% of said metallic and/or semi-metallic particulates, about 0.5 to about 5% of said aromatic polyester, and about 0.5 to about 5% of said indium, by weight.

5. The composition of claim 4, wherein said Jojoba base grease comprise a mixture of jojoba oil and colloidal silica.

6. The composition of claim 5, said metallic and semi-metallic solid particulate compositions including graphite, lead, zinc and copper.

7. The composition of claim 6, wherein said composition includes about 3 to about 20% powdered graphite, about 3 to about 35% lead powder, about 2 to about 15% zinc dust and about 2 to about 10% of copper flakes, by weight.

8. A lubricant composition particularly adapted for application to highly stressed thread or bearing surfaces to be exposed to high temperatuires, comprising essentially about 36% of a Jojoba based grease, about 16% of powdered graphite, about 29.5% lead powder, about 12.2% zinc dust, about 3.3% copper flake, about 1% of carbon monofluoride, about 1% of solid particulate aromatic polyester and about 1% of indium powder, by weight.

9. A process for lubricating thread or bearing surfaces which comprises applying to said surfaces a coating of the lubricant composition of claim 1.

10. A process for lubricating thread and bearing surfaces which comprises applying to said surfaces a coating of the lubricant composition of claim 4.

11. A process for lubricating thread and bearing surfaces which comprises applying to said surfaces a coating of the thread lubricant composition of claim 7.

12. A process for lubricating metal threads and bearing surfaces which comprises applying to said surfaces a coating of the thread lubricant composition of claim 8.

13. A composition for lubricating thread and bearing surfaces to be highly stressed and subjected to high temperatures comprising a grease having a principal oil constituent with a fume point in excess of 650° F., a major amount of metallic and/or semi-metallic particulate distributed within the grease, and less than 5% of a metallic powder having the property of diffusing on the surfaces to be lubricated and on the particulates.

14. The composition of claim 13 including in addition less than 10% of non-metallic lubricating particulates adapted to coat the surfaces to be lubricated and for which the metallic powder has an affinity.

15. The composition of claim 14 wherein the grease comprises jojoba oil-based grease thickened with approximately 20–35% of colloidal silica.

* * * * *